United States Patent [19]

Becker

[11] 3,955,385

[45] May 11, 1976

[54] APPARATUS FOR TREATING TEXTILE WEBS

[75] Inventor: Arno Becker, Freudenstadt, Germany

[73] Assignee: Bruckner Apparatebau GmbH, Erback, Odenwald, Germany

[22] Filed: July 8, 1974

[21] Appl. No.: 486,402

[30] Foreign Application Priority Data

July 26, 1973 Germany ..... 7327430

[52] U.S. Cl. ..... 68/4; 68/20; 68/202; 68/DIG. 5; 118/68; 118/246

[51] Int. Cl.[2] ..... D06B 1/14; D06B 21/02

[58] Field of Search ..... 68/19, 19.1, 20, 202, 68/5 D, 5 E, 4, 22 B, DIG. 5; 118/65, 67, 68, 246; 117/119.8; 34/242

[56] References Cited

UNITED STATES PATENTS

| | | | |
|---|---|---|---|
| 521,816 | 6/1894 | Reffitt | 68/202 X |
| 1,837,682 | 12/1931 | Searight | 118/67 |
| 2,311,616 | 2/1943 | Gordon et al. | 118/68 |
| 3,040,702 | 6/1962 | Eng et al. | 34/242 X |
| 3,260,000 | 7/1966 | Schiffer | 68/5 E X |
| 3,503,136 | 3/1970 | Fleissner | 68/DIG. 5 |
| 3,701,269 | 10/1972 | Wilcox | 68/19 |

FOREIGN PATENTS OR APPLICATIONS

| | | | |
|---|---|---|---|
| 1,430,549 | 1/1966 | France | 68/22 B |

*Primary Examiner*—Philip R. Coe
*Attorney, Agent, or Firm*—Learman & McCulloch

[57] ABSTRACT

Apparatus for applying a treatment medium to a continuously movable textile web and subsequently drying the web comprises a treatment housing wholly supported by and thermally insulated from a dryer housing so as to minimize greatly the space required for the successive treating and drying operations. The treating housing preferably contains means which are operable to enable the web selectively to be treated or not treated.

13 Claims, 3 Drawing Figures

APPARATUS FOR TREATING TEXTILE WEBS

This invention relates to a device for the application of a treatment medium to a continuously moving textile web and for the subsequent drying of this textile web, wherein the drying portion of the device contains a circulating air-permeable conveyor member for the textile web.

The treatment of textile webs, for instance for the achievement of water-repelling, oil-repelling or anti-static porperties, is effected by applying the appropriate chemical materials in a treatment section and subsequent drying of the treated textile web. While the application of the treatment media in general can be carried out very rapidly, the subsequent drying of the textile web involves some passage of time; the drying section in treatment plants must therefore have relatively large dimensions.

For this reason it is also desirable to be able to use the relatively expensive drying section when no treatment media are being applied to the textile web, and for instance when a different type of web-treatment, such as cleansing, is taking place.

The reverse case also frequently occurs, where an already existing dryer has to have at a later time a treatment stage installed ahead of it. In such cases there is often a considerable restriction on space, so that the treatment stage must make the minimum possible demands on space.

The invention has for a principal object the provision of textile treatment apparatus such that an existing dryer can without excessive difficulty be subsequently provided with an initial treatment stage, but that said treatment stage can also when necessary be readily taken out of operation, and in particular that the space required, especially the floor area, is not appreciably increased by the treatment stage.

According to the invention, this object is achieved in that the treatment section of the device, intended especially for treatment media dissolved in organic solvents, is provided as a section built into or onto the drying section, and thermally insulated from the drying section.

Where treatment media dissolved in organic solvents such as chlorinated hydrocarbons are used, the treatment section can be kept very small because of the short bath needed and the high treatment rate. In this manner the treatment section can take the form of a built-in or built-on section which can be constructed in or on a dryer without excessive difficulty, and can equally easily be applied to existing dryers.

With this closely adjacent spatial disposition of the treatment and drying sections it is however important for the treatment section to be adequately thermally insulated from the drying section, so that no appreciable amounts of heat can pass from the drying section to the treatment section and there increase too highly the temperature of the organic solvent.

The housing for the treatment section must also be effectively sealed from the exterior, especially in the area of the entry slot for the textile web, so that no solvent vapour can escape from the housing, and also so that the excess pressure prevailing in the drying section, conveyed via the textile web outlet slot from the treatment section housing into the drying housing, may be maintained.

The treatment section preferably contains at least one padding roller embraced by the textile web along an adjustable peripheral angle and preferably with a regulatable rotary speed.

In the treatment section, in particular in the area of movement of the textile web between the entry slot and the padding roller, there is preferably also provided a deflector roller whose spatial position may be varied so that the textile web can be selectively adjusted to pass over a desired peripheral section of the padding roller, or can run freely past the padding roller. The latter setting enables the drying section to be used for other purposes, for instance for simply drying a cleaned and still wet incoming textile web, without further alteration to the treatment section or the fabric feeder. In this way the drying section is usefully given a general application.

The invention is shown in the drawings in which.

Figure 1:
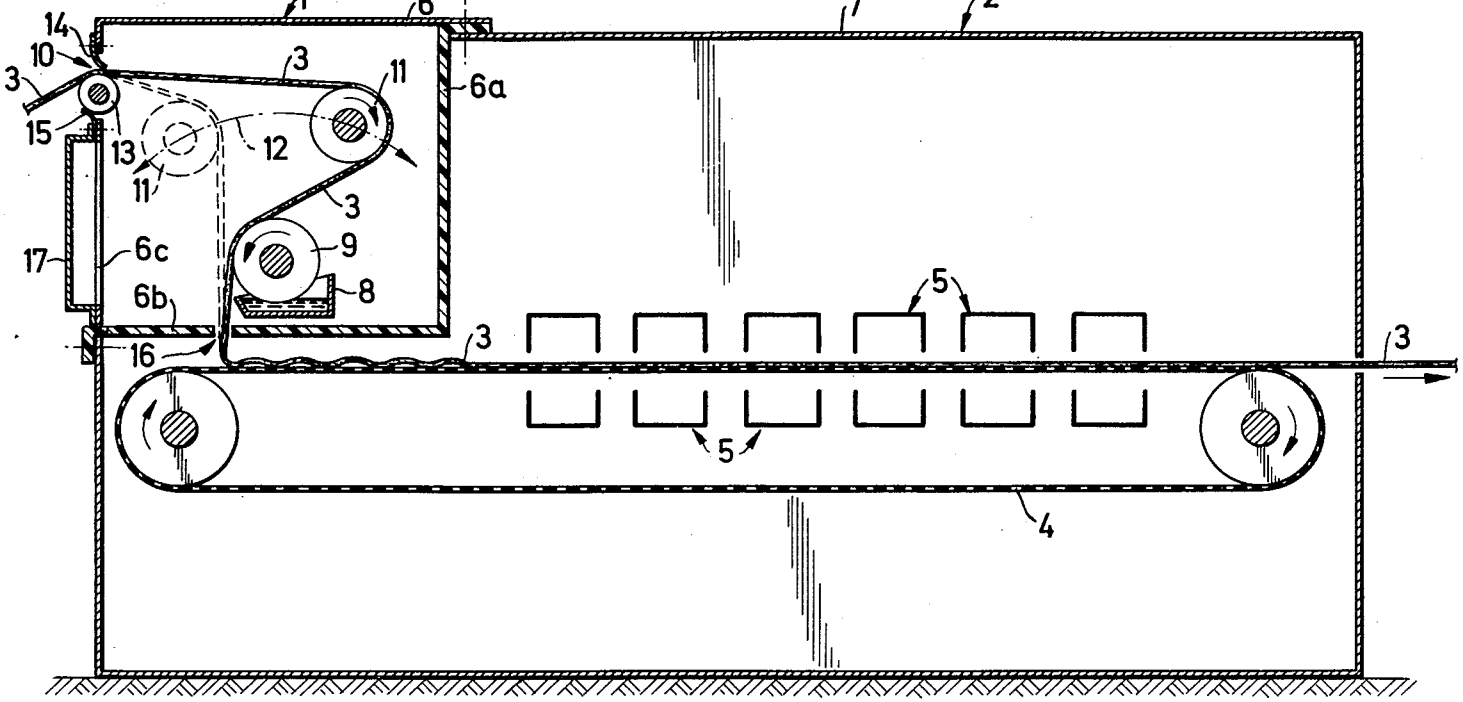
FIG. 1 is a diagrammatic, vertical sectional view of apparatus constructed according to one embodiment of the invention.

FIG. 1 shows a device with a treatment zone 1 and a drying zone 2. This drying zone 2 contains a conveyor belt 4 which forms a rotating air-permeable conveyor member for the textile web 3. In known manner the drying zone 2 is also provided with groups of nozzles 5 which cooperate (in a manner not shown in detail) with means for the treatment and circulation of air.

In the embodiment of FIG. 1 the application or treatment zone 1, which is intended for the application to a textile web 3 of treatment media dissolved in organic solvents, is defined by a housing 6 which forms a structure insertable in an opening found in the wall of a pre-existing housing 7 defining the drying section 2. At least the walls **6*a*, 6*b* of the housing 6 which face the interior of the drying zone 2 are thermally well insulated and have flanges which seat on the adjacent walls of the dryer housing 7 to provide support for the housing 6**.

The treatment zone 1 has a padding roller 9 dipping into a vat 8 and is embraced by the textile web 3 along an adjustable peripheral angle. For this purpose the area of movement of the textile web between the entry slot 10 and the padding roller 9 is provided with a deflector roller 11 which is mounted in a known manner so that it can be pivoted in the directions of the arrow 12. In this way the textile web can as desired be set to a particular angle of embracement of the padding roller 9 or, if the deflector roller 11 has assumed its left hand end position shown in dotted lines, the web is so deflected that it can run freely past the padding roller 9 when a purely drying process is being performed, with no other treatment.

To seal the interior of the housing 6, a roller 13 which co-operates with two flexible, spaced sealing lips 14, 15 and spans the distance between the lips is provided in the area of the textile web entry slot 10.

The treatment zone 1 communicates with the drying zone 2 via an outlet slot 16 located at the underside **6*b* of the housing 6 so that after passing through this slot with a vertical motion the textile web 3 reaches the conveyor belt 4** directly. After leaving the padding roller the textile web can obviously be led first over further deflector rollers.

In its one side wall (front wall **6*c*), the housing 6 for the treatment zone 1 has a large aperture closed by a removable cover 17 and through which the elements in the interior of the housing 6** are readily accessible.

Figure 2:
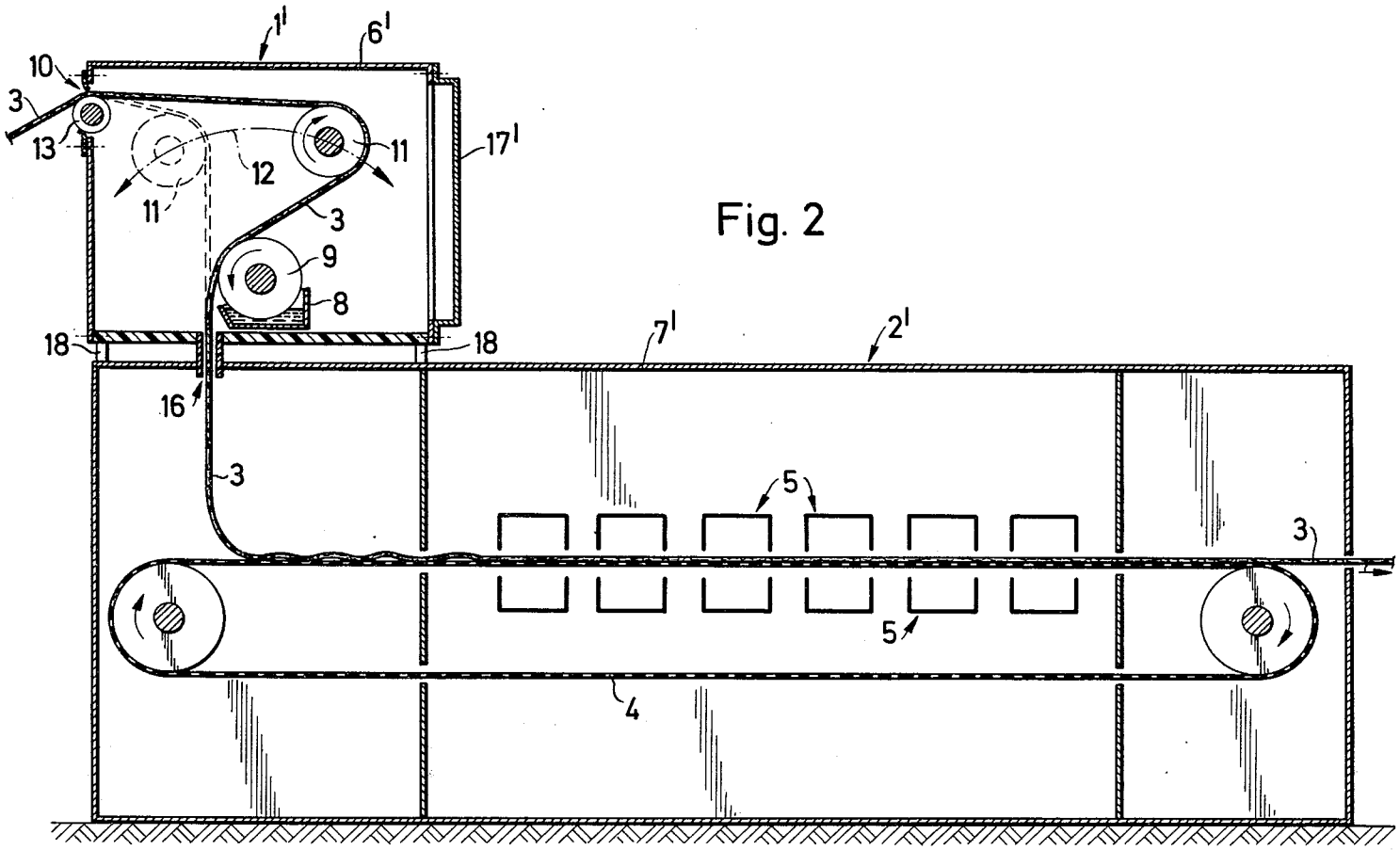
FIG. 2 is a view similar to FIG. 1 but illustrating a modified embodiment.

FIG. 2 shows an embodiment wherein the treatment zone 1' is defined by a housing 6' which can be placed as an extension on the housing 7' of the drying zone 2'.

Insofar as the treatment section of the embodiment in FIG. 2 coincides with that of FIG. 1, the same reference numbers are used. To this extent any separate description is unnecessary.

The housing 6' of the treatment zone 1' is provided with small area thermally insulated feet 18, by which it rests on the housing 7' of the drying zone 2'. In addition some or all of the walls of housing 6' can obviously also be thermally insulated.

As with the embodiment in FIG. 1, the textile web entry slot 10 is provided in a side wall of the housing 6' of the treatment zone 1'. In the embodiment in FIG. 2 however, the access aperture closed by a cover 17' is located on the opposite side wall of the housing.

Figure 3:
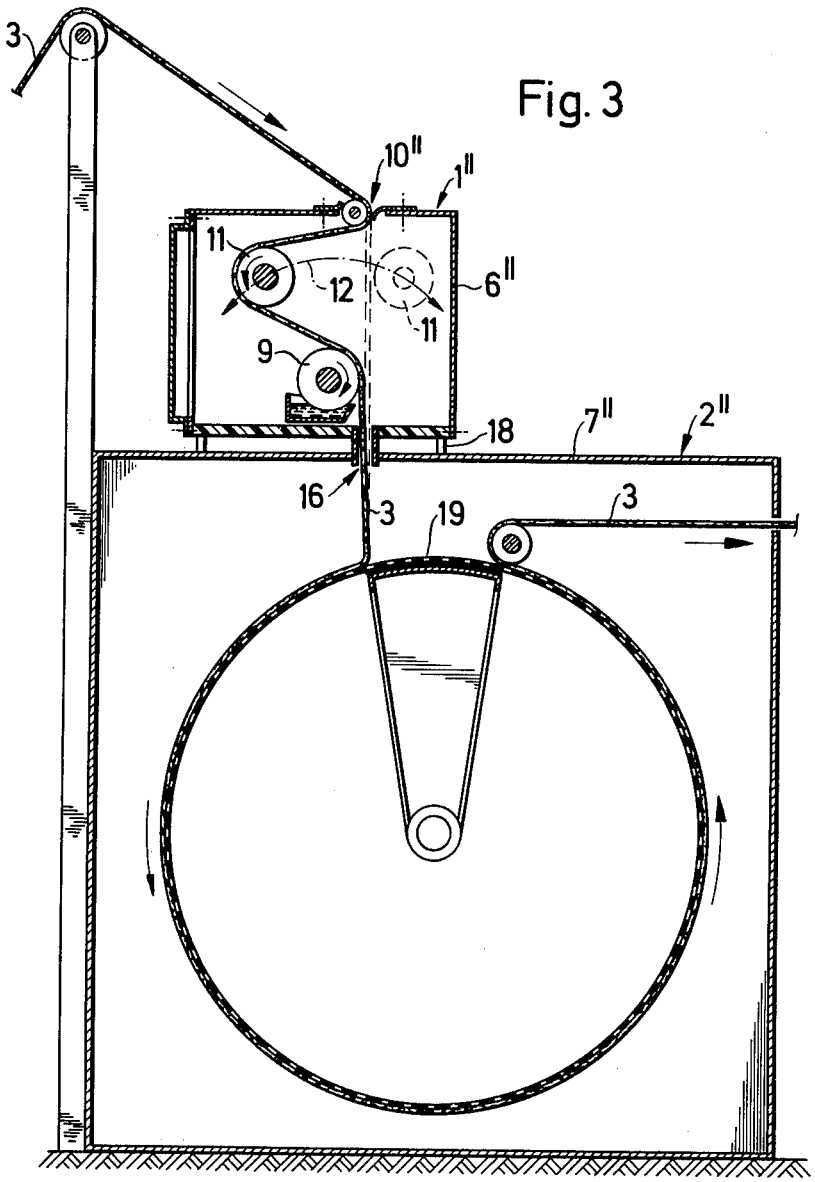
FIG. 3 is a similar view of a further modification.

Finally, FIG. 3 shows an embodiment wherein the treatment zone 1'' is defined by a housing 6'' which is also placed as an extension on the housing 7'' of a drying zone 2''. However, the rotating, air-permeable conveyor member in this drying zone 2'' is a suction drum 19. Here again the textile web outlet slot 16 is disposed so that the textile web 3 when treated by the padding roller 9 with the treatment medium moves vertically to reach the conveyor member, i.e. the suction drum 19, in direct manner. Alternatively the web can be first taken over further deflector rollers.

In the embodiment in FIG. 3 the textile web entry slot 10'' is provided in the roof of the housing 6'', so that the web 3 can be supplied from above.

I claim:

1. Apparatus for selectively applying or not applying a treatment medium to a continuously movable textile web and for subsequently drying said web, said apparatus comprising a drying housing defining a drying zone containing drying means for said web; a treatment housing defining a treatment zone containing means for applying a treatment medium to said web; an outlet slot in said treatment housing through which said web may leave said treatment housing; means mounting said treatment housing on said drying housing with said zones in communication via said outlet slot; thermal insulating means carried by said treatment housing for insulating the treatment zone from said drying zone; and web deflector means mounted in said treatment zone for engagement with said web and operable to deflect said web as it passes through said treatment zone into positions in which said treatment medium applying means is selectively enabled to apply or disabled from applying such medium to said web.

2. Apparatus according to claim 1 wherein said dryer housing has walls cut away to form an opening occupied by said treatment housing.

3. Apparatus according to claim 1 wherein said means for applying a treatment medium to said web comprises at least one padding roller engageable by said web.

4. Apparatus according to claim 3 wherein said deflector means comprises a roller.

5. Apparatus according to claim 4 wherein said deflector roller is bodily movable relatively to said padding roller for selectively deflecting said web into and out of engagement with said padding roller.

6. Apparatus according to claim 1 wherein said treatment housing has an inlet slot through which said web may enter said treatment housing.

7. Apparatus according to claim 6 including means for sealing said inlet slot.

8. Apparatus according to claim 1 wherein said drying means includes air permeable conveyor means.

9. Apparatus according to claim 8 wherein said conveyor means comprises an endless belt.

10. Apparatus according to claim 8 wherein said conveyor means comprises a suction drum.

11. Apparatus according to claim 1 wherein said treatment housing has a bottom wall in which said outlet slot is formed and said dryer housing has an upper wall provided with an opening in alignment with said outlet.

12. Apparatus for selectively applying or not applying a treatment medium to a continuously movable textile web and for subsequently drying said web, said apparatus comprising housing means having walls defining separate treatment and drying zones, said zones being in communication with one another whereby said web may pass from said treatment zone into said drying zone; means in said treatment zone for applying a treatment medium to said web; heating means in said drying zone for drying said web; thermal insulating means carried by the walls defining said treatment zone for insulating the latter from said drying zone; and deflector means mounted in said treatment zone for engagement with said web as it passes through said treatment zone and operable to deflect said web into positions in which said treatment medium applying means is selectively enabled to apply or disabled from applying such medium to said web.

13. Apparatus for applying an organic solvent to a continuously movable textile web and for subsequently drying said web, said apparatus comprising a dryer housing defining a drying zone and including heating means and conveyor means for conveying said web through said drying zone; an application housing having walls defining a treatment zone separate from said drying zone for the application of said solvent to said web; means mounting said application housing on said dryer housing with said treatment zone separated from said drying zone by at least one wall of said application housing, said application housing having a lowermost wall provided with an outlet slot in communication with said drying zone and through which said web may pass from said treatment zone into said drying zone, another of the walls of said treatment housing having an inlet slot into which said web may pass into said treatment zone; and thermal insulating means coextensive with and carried by each wall of said application housing which separates said zones from one another for thermally insulating said treatment zone from said drying zone.

* * * * *